United States Patent [19]

Wieselman et al.

[11] Patent Number: 4,544,990

[45] Date of Patent: Oct. 1, 1985

[54] ILLUMINATING TELESCOPIC DEVICE

[76] Inventors: Alex Wieselman, 4 Terry Ter., Livingston, N.J. 07039; Leonard D. Prince, 7855 Blvd. East, North Bergen, N.J. 07047

[21] Appl. No.: 651,251

[22] Filed: Sep. 17, 1984

[51] Int. Cl.[4] ..... F21V 7/04

[52] U.S. Cl. ..... 362/32; 362/198; 362/109; 362/204; 362/205; 362/295; 362/372

[58] Field of Search ..... 362/32, 202–205, 362/186, 198, 372, 109

[56] References Cited

U.S. PATENT DOCUMENTS 3,787,675 1/1974 Rushing et al. ..... 362/205 X 4,347,553 8/1982 Saron ..... 362/202 X 4,364,104 12/1982 Holahan et al. ..... 362/205 X

*Primary Examiner*—Peter A. Nelson

*Attorney, Agent, or Firm*—Lerner, David, Littenberg, Krumholz & Mentlik

[57] ABSTRACT

An illuminating telescopic device is described for use in a wide variety of applications, such as a signalling device, a conventional flashlight, an indicating light, a play light, and the like. The illuminating telescopic device includes one or more light transmissive extensible elements having a combined length greater than the length of its associated housing, so as to provide an effective signalling device when in use, while being compactly portable when stored within its housing.

24 Claims, 4 Drawing Figures

ILLUMINATING TELESCOPIC DEVICE

BACKGROUND OF THE INVENTION

The present invention relates in general, to a novelty light, and more specifically, to such a novelty light constructed to include a plurality of telescopically engaging light transmissive elements arranged within a compact housing and having a combined extended length greater than the length of the housing in order to provide for increased illumination of the surrounding environment while minimizing the overall size of the housing.

Illuminating devices are available in a wide variety of designs and adapted for use in an equal variety of applications. For example, light illuminating devices have played an important part in children's toys, signalling devices, conventional flashlights, and the like. One unique application contemplated by the inventors for an illuminating device is in the hailing of cabs and taxis. Hailing cabs and taxis in major cities has, since its inception, been a source of frustration due to the pedestrians' inability to make themselves visible to the cab drivers. Visible illumination lights used on the roofs of taxis communicate their availability to the pedestrians during both day and evening hours. Unfortunately, the reverse is not true. The pedestrian has no obvious way of catching the cab driver's attention, except by the traditional waving of their hand and/or throwing themselves in front of the oncoming cab. This problem is compounded in the evening when visibility is severely hampered.

There is known from U.S. Pat. No. 4,364,104 a foldable toy light having an appearance similar to that of a switchblade knife. The light includes a housing with an extensible element which rotates about its end from a position within the housing to a position extending away from the housing. A lamp within the extensible element, powered by batteries within the housing, illuminates the extensible element which is made of light transmissive material. The light, although specifically designed as a toy knife to prevent injury to the user, can also function as a signalling device. However, based upon its construction in simulating a switchblade knife, it is required that the housing be somewhat longer than the length of the extensible element. The use of such a light for a signalling device, on the other hand, mandates that the extensible element be as long as possible to insure the catching of one's attention. However, as the extensible element increases in length, so does its housing. In order that the light be portable and readily carried on one's person, it is required that the extensible element be relatively short, thereby reducing its effectiveness as a signalling device.

Accordingly, it can be appreciated that there is an unsolved need for an illuminating device which includes a light transmissive extensible element having a length greater than the length of the housing, so as to provide an effective signalling device when in use, while being compact and readily portable when stored within its housing.

SUMMARY OF THE INVENTION

It is broadly an object of the present invention to provide an illuminating telescopic device which overcomes or avoids one or more of the following disadvantages resulting from the use of the abovementioned prior art novelty light, and which fulfills the specific requirements of such an illuminating telescopic device having a light transmissive extensible element of substantially greater length than its associated housing. Specifically, it is within the contemplation of one aspect of the present invention to provide a novel illuminating telescopic device adapted for use in a wide variety of applications, such as a signalling device, a conventional flashlight, an indicating light, a play light, and the like.

Another object of the present invention is to provide an illuminating telescopic device, when collapsed, is of a size sufficiently small enough to fit into a man's breast-pocket, or a woman's average-sized handbag, and having a housing of pleasing construction such as round, oval, rectangular or triangular.

Another object of the present invention is to provide an illuminating telescopic device having a plurality of light transmissive extensible elements arranged in telescopic engagement and whose combined length is substantially greater than the length of its housing.

Another object of the present invention is to provide an illuminating telescopic device which is simple to manufacture and assemble from, for example, molded plastic parts.

Another object of the present invention is to provide an illuminating telescopic device which is adapted for light emitting operation when its light transmissive extensible elements are arranged either within its housing or extending away therefrom.

Another object of the present invention is to provide an illuminating telescopic device which includes a self-contained power source and means for internal illumination.

In accordance with one embodiment of the present invention, there is provided a light illuminating device constructed of a housing, an element mounted for extension along its longitudinal axis from a position within the housing to a position extending away from the housing, and means for internally illuminating the element.

In accordance with another embodiment of the present invention, there is provided a light illuminating device constructed of a housing, a first element mounted for extension along its longitudinal axis from a position within the housing to a position extending away from the housing, a second element mounted for extension along the longitudinal axis of said first element from a position within the first element to a position extending away from the first element, and means for internally illuminating the first and second elements.

BRIEF DESCRIPTION OF THE DRAWINGS

The above description, as well as further objects, features and advantages of the present invention will be more fully understood by reference to the following detailed description of a presently preferred, but nonetheless illustrative, illuminating telescopic device in accordance with the present invention when taken in conjunction with the accompanying drawings, wherein:

FIG. 5 is a partial cross-sectional view of the light transmissive extensible elements as shown in FIG. 1, and illustrating their telescopic arrangement within one another, including securing means for securing their respective extended and collapsed position within one another and within their housing.

DETAILED DESCRIPTION OF THE PREFERRED EMBODIMENTS

Figure 1:
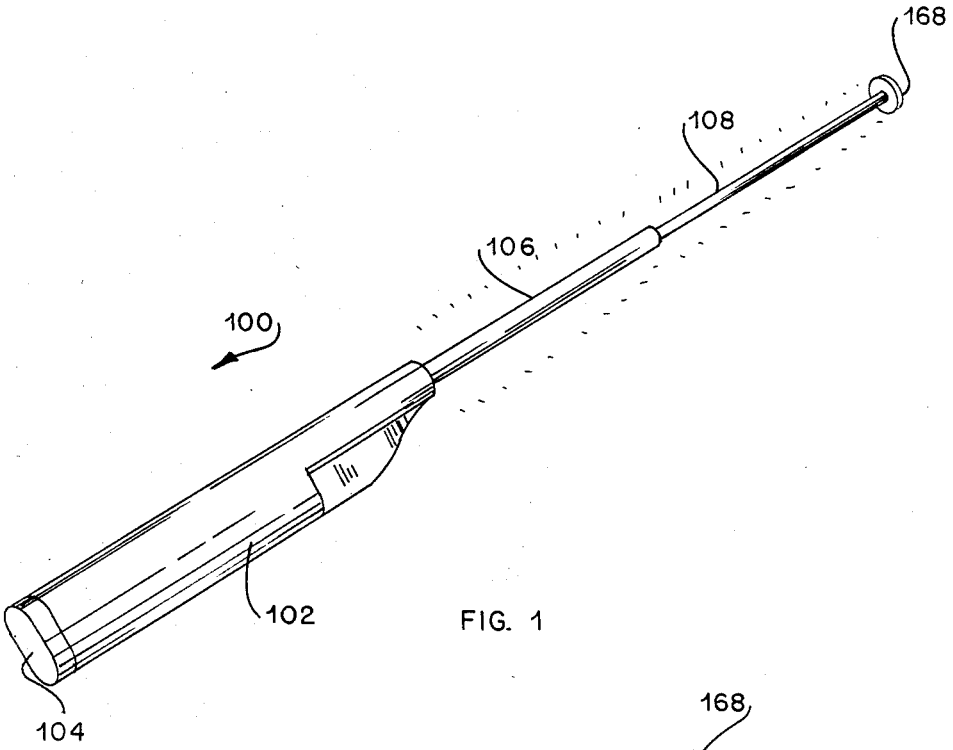
FIG. 1 is a perspective view of the illuminating telescopic device of the present invention, and illustrating same in an operative position with its light transmissive extensible elements arranged telescopically extending away from their housing.
Figure 2:
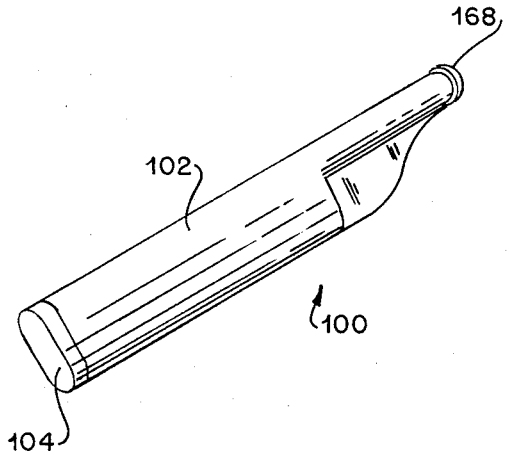
FIG. 2 is a perspective view of the illuminating telescopic device, as shown in FIG. 1, and illustrating the device with its light transmissive extensible elements arranged within their housing in a collapsed condition, so as to be arranged substantially co-extensive with one another.

Referring now to the drawings, wherein like reference numerals represent like elements, there is shown in FIG. 1 a perspective view of the illuminating telescopic device generally designated by reference numeral 100. The illuminating telescopic device 100 is constructed of a housing 102, an end closure cap 104, and one or more light transmissive extensible elements 106, 108. In FIG. 1, the light transmissive elements 106, 108 are illustrated in an open position extending away from the housing 102, while in FIG. 2, the elements are illustrated in a substantially co-extensive collapsed position within the housing. In this regard, the combined length of the light transmissive elements 106, 108, when in their fully extended position is greater than the length of the housing 102. The feature of the present invention is made possible by the fact that the light transmissive elements 106, 108 are telescopically arranged for extension along their longitudinal axis and that of the housing 102, from their extended position as shown in FIG. 1 to their collapsed position as shown in FIG. 2. Although the present invention has thus far been described to include two light transmissive elements 106, 108, it is to be understood that any number of such elements may be employed in telescopic relationship to provide an effective illuminating telescopic device 100 having an increased area for illumination.

Figure 3:
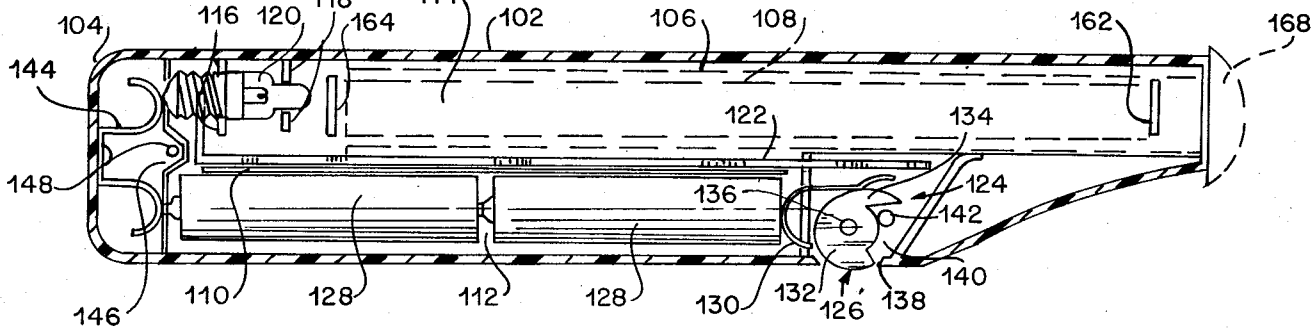
FIG. 3 is a partial cross-sectional view of the housing, and illustrating the construction and arrangement of the illuminating telescopic device's internal light source, power supply and switching element.

Referring now to FIG. 3, the housing 102 is constructed of molded plastic material and includes a longitudinally extending retaining wall 110 which divides the housing into a battery compartment 112 and an element receiving compartment 114. Two pairs of spaced-apart ribs 116, 118 are arranged within the element receiving compartment 114 to provide support for a light bulb 120 of the conventional flashlight type. The light bulb 120 is arranged at the left-most end of the element receiving compartment 114, as shown in FIG. 3, and in alignment with the longitudinal axis of the light transmissive elements 106, 108. A contact lead 122 extends from the light bulb 120 within the element receiving compartment 114, along the retaining wall 110, and terminates within a switch compartment 124. A switch 126 is arranged within the switch compartment 124 to provide electrical contact between the light bulb 120, via the contact lead 122, and a plurality of batteries 128 arranged within the battery compartment 112.

The switch 126 is constructed of a flexible resilient contact lead 130 having a portion extending into the battery compartment 112 for engagement with the batteries 128 and another portion extending into the switch compartment 124 adjacent contact lead 122. A cam 132 having a lobe 134 is rotationally mounted within the switch compartment 124 about a pin 136 and having a portion of the cam extending through an opening 138 within the housing 102. The cam 132 is provided with a cutout 140 to capture a pin 142 for limiting the permissible rotational movement of the cam. In addition to the switch 126, a contact lead 144 is arranged within the end closure cap 104 to provide electrical continuity between one terminal of the batteries 128 and one terminal of the light bulb 120.

Figure 4:
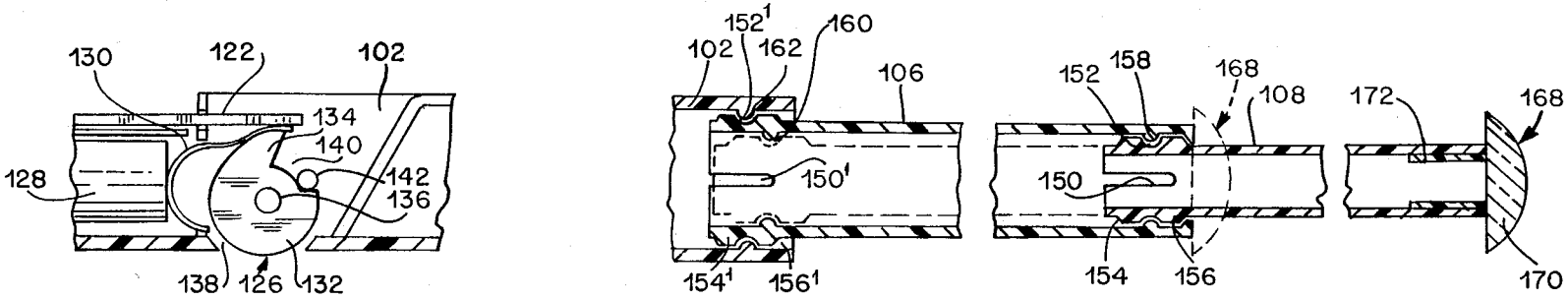
FIG. 4 is a partial cross-sectional view of the switching element, as shown in FIG. 3, and illustrating same in further detail in an operative closed circuit position to supply power to the light source via the power supply.

The switch 126 is shown in FIG. 3 to provide an open circuit, while being shown in FIG. 4 to provide a closed circuit. The obtaining of a closed circuit is acheived by rotating cam 132 counterclockwise about pin 136 such that the extending lobe 134 urges that portion of the contact lead 130 within the switch compartment 124 into electrical continuity with the contact lead 122. The cam 132, having a portion extending through the opening 138, can be conveniently rotated using a portion of one's finger. The extent of rotation of the cam 132 in a counterclockwise direction is limited by pin 142 engaging the end wall of the cutout 140. Likewise, the rotation of the cam 132 in a clockwise direction to obtain an open circuit, as shown in FIG. 3, is limited by pin 142 engaging the opposite end wall of the cutout 140. Thus, operation of the switch 126 provides electrical continuity between the batteries 128 and the light bulb 120 via contact leads 122, 130, 144.

The end closure cap 104 is removably secured to the housing 102 to provide access to the battery compartment 112 for replacement of the batteries 128 and to provide access to the element receiving compartment 114 for replacement of the light bulb 120. The end closure cap 104 is constructed to include a pair of opposed resilient projections 146, each including a retaining pin 148. The retaining pins 148 are constructed and arranged to be received within an opening (not shown) provided within the internal surface of the housing 102. In this manner, the end closure cap 104 may be removably secured to the housing 102 when in use, while being readily removed therefrom to permit accesss to the battery compartment 112 and element receiving compartment 114.

Referring now to FIG. 5, the construction and arrangement of the light transmissive extensible elements 106, 108 will be described. The light transmissive elements 106, 108 are constructed of hollow tubes from ABS powder by a suitable molding process. To the ABS powder, one or more colorants are added to provide the light transmitting characteristics desired. In this regard, the light transmissive elements 106, 108 may be any color desired to achieve the transmission of colored light, thereby making the illuminating telescopic device 100 more visible. In addition, the light transmitting characteristics of the light transmissive elements 106, 108 may be varied along their respective lengths to achieve unusual and special light effects.

Light transmissive element 106 is telescopically arranged along its longitudinal axis, as well as that of the element receiving compartment 114 within the housing 102, as more clearly shown in phantom in FIG. 3. Similarly, light transmissive element 108 is telescopically arranged along its longitudinal axis, as well as that of the light transmissive element 106. The telescopic arrangement of the light transmissive elements 106, 108 is made possible by the external diameter of element 108 being slightly smaller than the internal diameter of element 106, and the external diameter of element 106 being slightly smaller than the internal diameter of the element receiving compartment 114. Although the illuminating telescopic device 100 has been described as including two light transmissive extensible elements 106, 108, it is to be understood that any number of such elements may be employed in telescopic arrangement with one another.

The captured ends of the light transmissive elements 106, 108 are provided with at least one longitudinally extending slot 150, 150', a groove 152, 152' circumscribing the exterior surface of the elements, and a pair of cam surfaces 154, 156 and 154', 156' arranged on either side of the groove. A rib 158 is arranged at least partially circumscribing the interior surface of the light transmissive element 106 adjacent its forward end. Similarly, a rib 160 is arranged internally at the captured end of light transmissive element 106, a rib 162 is arranged internally at the forward end of the element receiving compartment 114, and a rib 164 is arranged internally within the element receiving compartment adjacent the light bulb 120. Light transmissive element 108 further includes a focusing element 168 provided at its forward end. The focusing element 168 is constructed of a lens 170 secured to the light transmissive element 106 by an internal securing member 172.

Light transmissive elements 106, 108 are assembled in telescopic arrangement with one another and within the element receiving compartment 114 of the housing 102 in the manner as shown in FIG. 5. Specifically, light transmissive element 106 is secured within the element receiving compartment 114 in its collapsed position as shown in FIG. 2 and in phantom in FIG. 3, by the engagement of rib 164 within the groove 152'. Light transmissive element 106 is further secured in a position extending away from the housing, as shown in FIGS. 1 and 5, upon engagement of the rib 162 with the groove 152'. In a similar arrangement, light transmissive element 108 is secured in its collapsed substantially co-extensive position within the light transmissive element 106 by engagement of the rib 160 with the groove 152, as shown in phantom in FIG. 3, and in its position extending away from the light transmissive element 106 upon engagement of the rib 158 with the groove 152, as shown in FIG. 5.

The operation of the illuminating telescopic device 100 in accordance with the present invention will now be described. The illuminating telescopic device 100 is initially arranged as shown in FIG. 2 with the light transmissive elements 106, 108 being collapsed telescopically within the housing 102, which housing is constructed of non-light transmitting material. In this position, the light transmissive element 106 is secured within the element receiving compartment 114 by the rib 164 engaging the groove 152'. Similarly, the light transmissive element 108 is secured telescopically within the light transmissive element 106 by engagement of the rib 160 with the groove 152, such that the focusing element 168 is positioned adjacent the forward end of the housing 102. This arrangement of the illuminating telescopic device 100 permits its use as a conventional flashlight upon activation of the switch 126, as light from the light bulb 120 will be emitted only from the focusing element 168.

At such time as it is desired to utilize the illuminating telescopic device 100 in the manner of a signal device, one merely grabs the focusing element 168 and withdraws the light transmissive elements 106, 108 along their respective longitudinal axes, e.g., along the longitudinal axes of the element receiving compartment 114. As light transmissive element 106 is withdrawn outwardly from the element receiving compartment 114, cam surface 156' engages rib 162 so as to depress the elements' captured end as a result of the slot 150', and then engages the groove 152'. Similarly, rib 158 engages cam surface 156 of the light transmissive element 106 so as to depress its captured end via slot 150, and then engages the groove 152. The light transmissive elements 106, 108 are now fully extended away from the housing 102, as shown in FIG. 1, to provide a signalling device having a relatively large surface area. As evidenced from the foregoing construction, the combined length of the light transmissive elements 106, 108 is greater than the length of the housing 102. Light from the light bulb 120 is emitted through the walls of the light transmissive elements 106, 108, as well as through the focusing element 168.

To collapse the light transmissive elements 106, 108, a reverse procedure is followed. In this regard, one merely applies pressure to the focusing element 168 to cause disengagement between the ribs 158, 162 with their respective grooves 152, 152'. As the cam surface 154 of light transmissive element 108 approaches rib 160, its captured end is depressed via slot 150 so as to engage the groove 152 for retaining the light transmissive element in co-extensive relationship within light transmissive element 106. Similarly, as cam surface 154' of light transmissive element 106 approaches the rib 164 adjacent light bulb 120, its captured end is depressed via slot 150' so as to engage the groove 152' in order to retain the light transmissive element within the element receiving compartment 114. Accordingly, the illuminating telescopic device 100 of the present invention, when collapsed, is of a size sufficiently small enough to fit into a man's breastpocket or a woman's average-sized handbag, while, on the other hand, when extended provides an efficient and effective signalling device.

Although the invention herein has been described with reference to particular embodiments, it is to be understood that these embodiments are merely illustrative of the principles and application of the present invention. For example, although the present invention has been described with particular reference to a signalling device, e.g., for hailing taxis and cabs, it is to be understood that the present invention may be employed in any number of applications and may be constructed in a variety of manners. In addition, although the housing 102 has been described as being constructed of non-light transmitting material, the housing may be constructed of light transmitting material in the manner of light transmissive extensible elements 106, 108. It is to be understood, therefore, that numerous modifications may be made in the illustrative embodiment and that other arrangements may be devised without departing from the spirit and scope of the present invention as defined by the appended claims.

We claim:

1. A light illuminating device comprising a housing having an internal compartment, an element mounted for extension along its longitudinal axis from a storage position within said compartment and internally of said housing to an operative position extending away from said compartment and externally of said housing, and means contained within said housing for internally illuminating said element when in said operative position.

2. The light illuminating device of claim 1, wherein said element is at least partially constructed of light transmissive material.

3. The light illuminating device of claim 1, wherein said illuminating means comprises a source of light.

4. The light illuminating device of claim 3 further including focusing means arranged at one end of said element for focusing said light externally of said housing.

5. The light illuminating device of claim 1 further including means for releasably securing said element in its position within said housing and in its position extending away from said housing.

6. The light illuminating device of claim 5, wherein said securing means comprises a groove within the exterior of said element and a rib within the interior of said housing, said rib constructed and arranged to be received within said groove for securing said element.

7. The light illuminating device of claim 1, wherein said element comprises a longitudinally extending light transmissive hollow tube.

8. A light illuminating device comprising a housing having an internal compartment, a first element mounted for extension along its longitudinal axis from a storage position within said compartment and internally of said housing to an operative position extending away from said compartment and externally of said housing, a second element mounted for extension along the longitudinal axis of said first element from a storage position within said first element to an operative position extending away from said first element and externally of said housing, and means contained within said housing for internally illuminating said first and second elements when one of said elements is in said operative position.

9. The light illuminating device of claim 8, wherein said first and second elements are at least partially constructed of light transmissive material.

10. The light illuminating device of claim 9, wherein the light transmissive characteristics of said first and second elements vary over the length of said elements.

11. The light illuminating device of claim 8, wherein said illuminating means comprises a source of light.

12. The light illuminating device of claim 11 further including focusing means arranged at one end of said second element for focusing said light externally of said housing.

13. The light illuminating device of claim 12, wherein said focusing means is arranged external to and adjacent said housing when said first element is within said housing and said second element is within said first element.

14. The light illuminating device of claim 8, wherein said first and second elements are substantially co-extensive when said second element is within said first element.

15. The light illuminating device of claim 8, wherein said first and second elements comprise longitudinally extending light transmissive hollow tubes.

16. The light illuminating device of claim 15, wherein the internal diameter of said first element is greater than the external diameter of said second element.

17. The light illuminating device of claim 8 further including first securing means for releasably securing said first element in its position within said housing and in its position extending away from said housing.

18. The light illuminating device of claim 17 further including second securing means for releasably securing said second element in its position within said first element and in its position extending away from said first element.

19. The light illuminating device of claim 18, wherein said first securing means comprises a groove within the exterior of said first element and a rib within the interior of said housing, said rib constructed and arranged to be received within said groove.

20. The light illuminating device of claim 18, wherein said second securing means comprises a groove within the exterior of said second element and a rib within the interior of said first element, said rib constructed and arranged to be received within said groove for securing said second element within said first element.

21. The light illuminating device of claim 20, wherein said second securing means includes a cam surface arranged for engaging said rib to facilitate the receiving of said rib within said groove.

22. The light illuminating device of claim 8, wherein said second element is arranged in telescopic relationship within said first element and said first and second elements are arranged in telescopic relationship within said housing.

23. The light illuminating device as set forth in claim 8, wherein the extended combined length of said first and second elements is greater than the length of said housing.

24. The light illuminating device as set forth in claim 8, wherein said housing is constructed of light transmitting material.

* * * * *